US009109802B2

(12) United States Patent
Dettloff et al.

(10) Patent No.: US 9,109,802 B2
(45) Date of Patent: Aug. 18, 2015

(54) METHOD OF CONVERTING AN OPEN-TOP GAS BURNER ARRANGEMENT INTO AN INFRARED RADIANT BURNER ARRANGEMENT

(75) Inventors: Stanley E. Dettloff, Kings Mountain, NC (US); David W. Martin, Charlotte, NC (US)

(73) Assignee: PREMARK PEG L.L.C.

( * ) Notice: Subject to any disclaimer, the term of this patent is extended or adjusted under 35 U.S.C. 154(b) by 536 days.

(21) Appl. No.: 13/482,244

(22) Filed: May 29, 2012

(65) Prior Publication Data

US 2012/0304980 A1 Dec. 6, 2012

Related U.S. Application Data

(60) Provisional application No. 61/492,110, filed on Jun. 1, 2011.

(51) Int. Cl.

| | |
|---|---|
| ***F24C 3/04*** | (2006.01) |
| ***F24C 3/08*** | (2006.01) |
| ***F23D 14/12*** | (2006.01) |

(52) U.S. Cl.

CPC ..... *F24C 3/085* (2013.01); *F23D 14/125* (2013.01); *F24C 3/047* (2013.01); *F23D 2203/005* (2013.01); *Y10T 29/49348* (2015.01)

(58) Field of Classification Search

CPC ..... F24C 3/00; F24C 3/02; F24C 3/027; F24C 3/04; F24C 3/047; F24C 3/06; F24C 3/067; F24C 3/08; F24C 3/085

See application file for complete search history.

(56) References Cited

U.S. PATENT DOCUMENTS

| | | | | |
|---|---|---|---|---|
| 4,083,355 | A | 4/1978 | Schwank | |
| 6,517,345 | B1 * | 2/2003 | Wu | 431/344 |
| 7,726,967 | B2 | 6/2010 | Best | |
| 2006/0003277 | A1 * | 1/2006 | Jeng | 431/263 |
| 2006/0024632 | A1 * | 2/2006 | Sanchez | 431/354 |
| 2006/0147865 | A1 | 7/2006 | Czajka et al. | |
| 2007/0204852 | A1 * | 9/2007 | Cohen | 126/273.5 |

FOREIGN PATENT DOCUMENTS

| | | |
|---|---|---|
| DE | 2621801 | 12/1977 |
| EP | 1308675 | 7/2003 |

OTHER PUBLICATIONS

International Search Report and Written Opinion, Mailed Aug. 6, 2012, PCT/US2012/039808, 11 pages.

* cited by examiner

*Primary Examiner* — David J Laux
(74) *Attorney, Agent, or Firm* — Thompson Hine LLP

(57) ABSTRACT

A method for modifying an open-top burner system to a radiant burner system involves providing a stovetop having an open top burner system which includes a grate, burner head, and a venturi burner. The venturi burner includes an open top annular channel about a central opening. Further provided are a central hole plug, an emitter, and a radiant burner head assembly. To modify the stovetop, the grate and burner head are removed from the stovetop and the central plug is used to block airflow through the central opening. The radiant burner head assembly is next positioned over the venturi burner and the emitter is positioned over the radiant burner head assembly. This series of steps thereby converts the assembly from a traditional open-top burner system to a radiant burner system. A kit may be provided to facilitate the process.

13 Claims, 7 Drawing Sheets

METHOD OF CONVERTING AN OPEN-TOP GAS BURNER ARRANGEMENT INTO AN INFRARED RADIANT BURNER ARRANGEMENT

CROSS-REFERENCE

This application claims the benefit of U.S. Provisional Application Ser. No. 61/492,110, filed Jun. 1, 2011, the entirety of which is hereby incorporated by reference.

TECHNICAL FIELD

The present disclosure relates to a method of converting a gas burner from an open top arrangement to an infrared radiant burner system, and the resulting apparatus.

BACKGROUND

Gas fired cooking ranges have achieved wide acceptance in both residential and commercial kitchens. A known design for gas fired cook tops in ranges includes separate burner assemblies for each cooking location, with each burner assembly including a venturi and a burner head having gas-emitting orifices. A grate or other surface is often positioned above the burner head and venturi to provide a surface for pots, pans, other cooking vessels, or food products.

Factors such as flame intensity and efficiency, burner assembly cleanability, and fuel consumption efficiency are important to both residential and commercial installations. The time required for completing a food course, including initial preparation time for heating and actual cooking time, can be reduced by efficient burner performance and heat transfer to the cooking vessel atop the burner.

This arrangement is traditionally considered inefficient as the system heats the air around the grate, eventually transferring heat to the pot, pan, or food product placed thereon. A more efficient system is that described in U.S. Pat. No. 7,726,967, that describes a gas-fed infrared burner. Gas-fed infrared burners are more efficient than similar open-top gas-fired burners, and therefore their use reduces energy consumption while improving cooking times.

An infrared radiant burner stovetop assembly is an expensive replacement for an open-top gas burner and may require substantial modification of the kitchen, stovetop, and cooking arrangement.

Therefore, there is a need in the art for an improved method and apparatus for replacing an open-top gas burner arrangement with an infrared radiant burner arrangement.

SUMMARY

Described herein is a method for modifying an open-top burner system to a radiant burner system. This modification is achieved by providing a stovetop having an open top burner system that includes a grate, burner head, and a venturi burner. The venturi burner includes an open top annular channel about a central opening. Further provided are a central hole plug, an emitter, and a radiant burner head assembly. To modify the stovetop, the grate and burner head are removed from the stovetop and the central plug is used to block (substantially or entirely) airflow through the central opening of the venturi burner. The radiant burner head assembly is next positioned over the venturi burner and the emitter is positioned over the radiant burner head assembly. This series of steps converts the assembly from a traditional open-top burner system to a radiant burner system.

According to various further embodiments, the radiant burner head assembly may include a plenum and a perforated member. The radiant burner head assembly may further include a spacer for separating two or more perforated members. According to another embodiment, the stovetop may include a support for supporting the grate that is used to support the emitter.

Also disclosed is an apparatus or kit for converting a traditional open top burner system to a radiant burner system. The traditional open top burner system generally includes a venturi burner with a central opening, a burner head, and a grate. The apparatus or kit includes a plug for blocking secondary air flow through the central opening, a radiant burner head assembly that is sized to rest on the venturi burner, and an emitter that replaces the grate.

According to various further embodiments, the radiant head assembly may include a plenum with an opening for fitting over the venturi burner. The radiant head assembly may also include one or more perforated members and one or more support members. The support members may be positioned between adjacent perforated members. According to yet another embodiment, the radiant burner assembly may include baffle and burner assemblies.

The details of one or more embodiments are set forth in the accompanying drawings and the description below. Other features, objects, and advantages will be apparent from the description and drawings, and from the claims.

DETAILED DESCRIPTION

Figure 1:
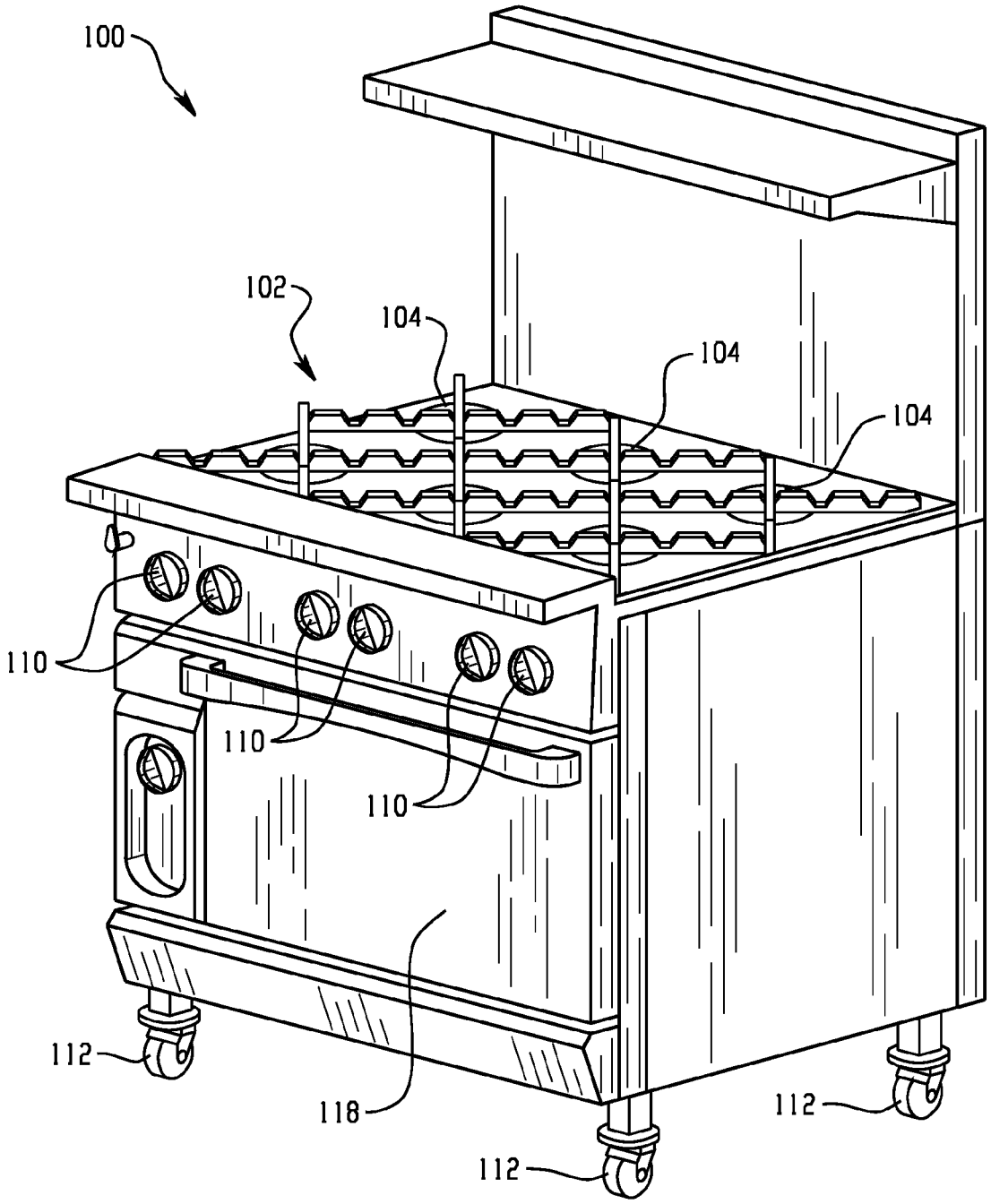
Fig. 1 PRIOR ART
FIG. 1 is a perspective view of one embodiment of a gas cooking range.

Referring to FIG. 1, numeral 100 designates a gas cooking range having a cooktop 102 with multiple cooking locations 104 (e.g., six in the illustrated embodiment, 3 front and 3 back) with associated burner heads. In one embodiment, pairs of burner heads are formed by burner head assemblies 106 (see FIG. 2), but each burner head could be formed and fed with gas on an individual basis. Range 100 further includes an oven chamber 118 beneath the cooktop area. The range 100 may be a commercial range or a residential range, taking on a variety of configurations, of which FIG. 1 is merely exemplary.

Range 100 includes a gas circuit for supplying combustible gas to each burner head and to an oven burner assembly (not shown). The gas circuit includes a plurality of flow control valves 110 provided for initiating, terminating, and controlling the rate of gas flow to cooking locations 104 on cook top 102. Various valve configurations and gas flow circuits could be used. Illustrated range 100 is supported on casters 112, by which range 100 can be moved a short distance to clean the area around the range. However, embodiments without casters are contemplated.

Exemplary burner head assembly 106 includes a first burner head 120 and a second burner head 122 at which combustion of gaseous fuel occurs. A single piece, monolithic casting 124 forms a first venturi 126 associated with or feeding a first burner head base 128 and a second venturi 130 associated with or feeding a second burner head base 132. The burner head base 128, 132 may be alternatively referred to as a venturi burner. First venturi 126 and second venturi 130 provide a flow of gas and primary combustion air for combustion at first and second burner heads 120, 122, respectively, in front and back locations, respectively, on cook top 102. First and second gas receivers 134, 136, are provided on first venturi 126 and second venturi 130, respectively. Each receiver 134, 136 is aligned and/or connected with a different control valve 110 to receive gas therefrom when the control valve 110 is opened to allow gas to flow therethrough. Receivers 134, 136 also admit a flow of ambient air to mix with the combustible gas in first venturi 126 and second venturi 130 to provide a combustible mixture to burner heads 106, 122.

Figure 2:
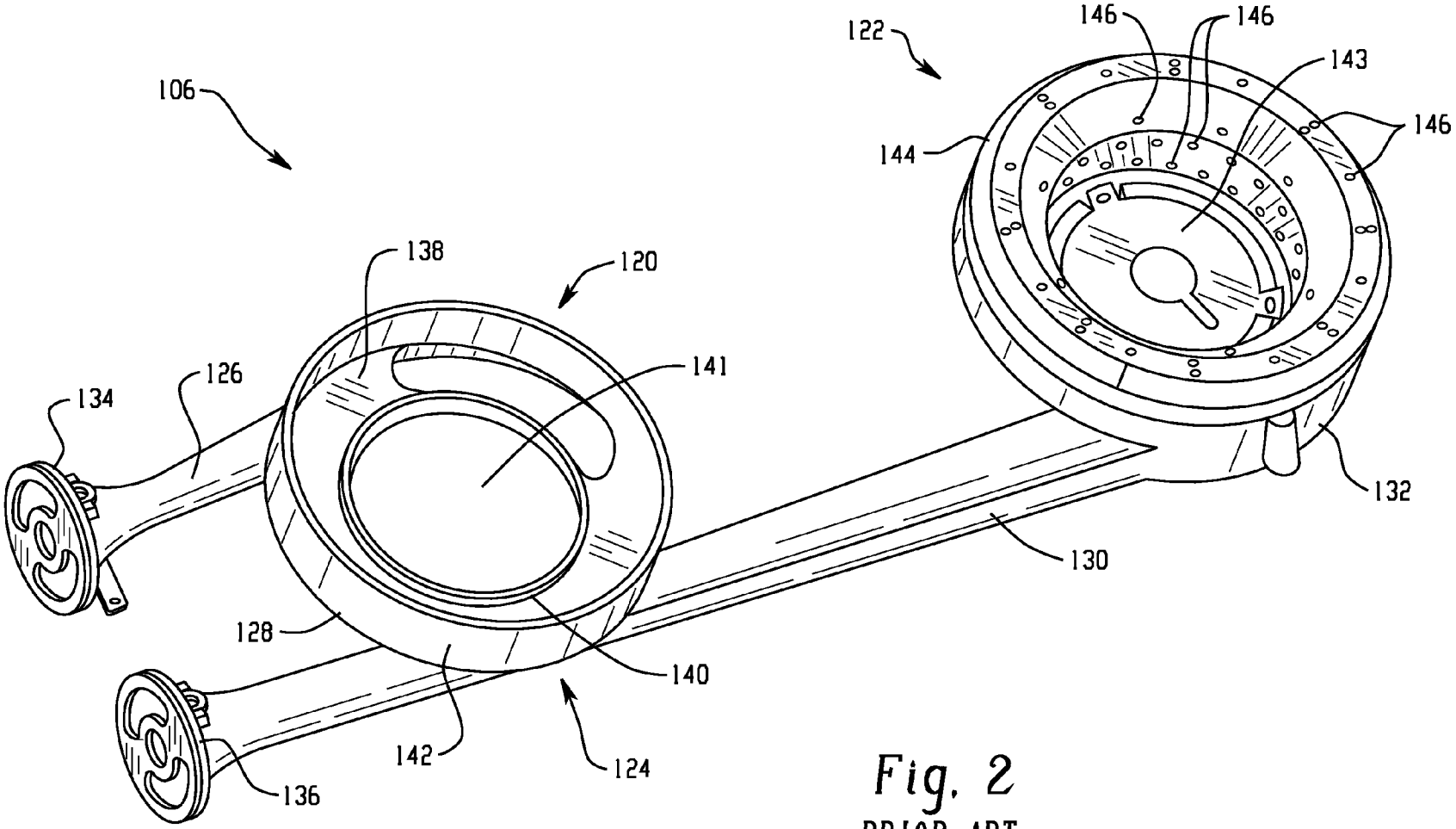
Fig. 2 PRIOR ART
FIG. 2 is a perspective view of one embodiment of a duel burner head unit.

FIG. 2 illustrates burner head assembly 106 in a partial state of disassembly. Each burner head base 128, 132 may be a substantially annular body defining an open top annular channel 138 between an inner wall 140 and an outer wall 142. Annular channel 138 of burner head base 128 is visible in FIG. 2. Prior to conversion, burner head cover 144 may be provided on each burner head base 128, 132, with cover 144 on burner head base 132 being shown in FIG. 2. Each cover 144 has a plurality of gas-emitting orifices 146 therein through which a mixture of combustible gas and primary combustion air is emitted. The inner wall 140 further surrounds a central opening 141 that provides an upward secondary air flow to the combustion space. This central opening 141 may include a restrictor plate (shown as 143 for head 122) that meters or regulates air flow.

Figure 3:
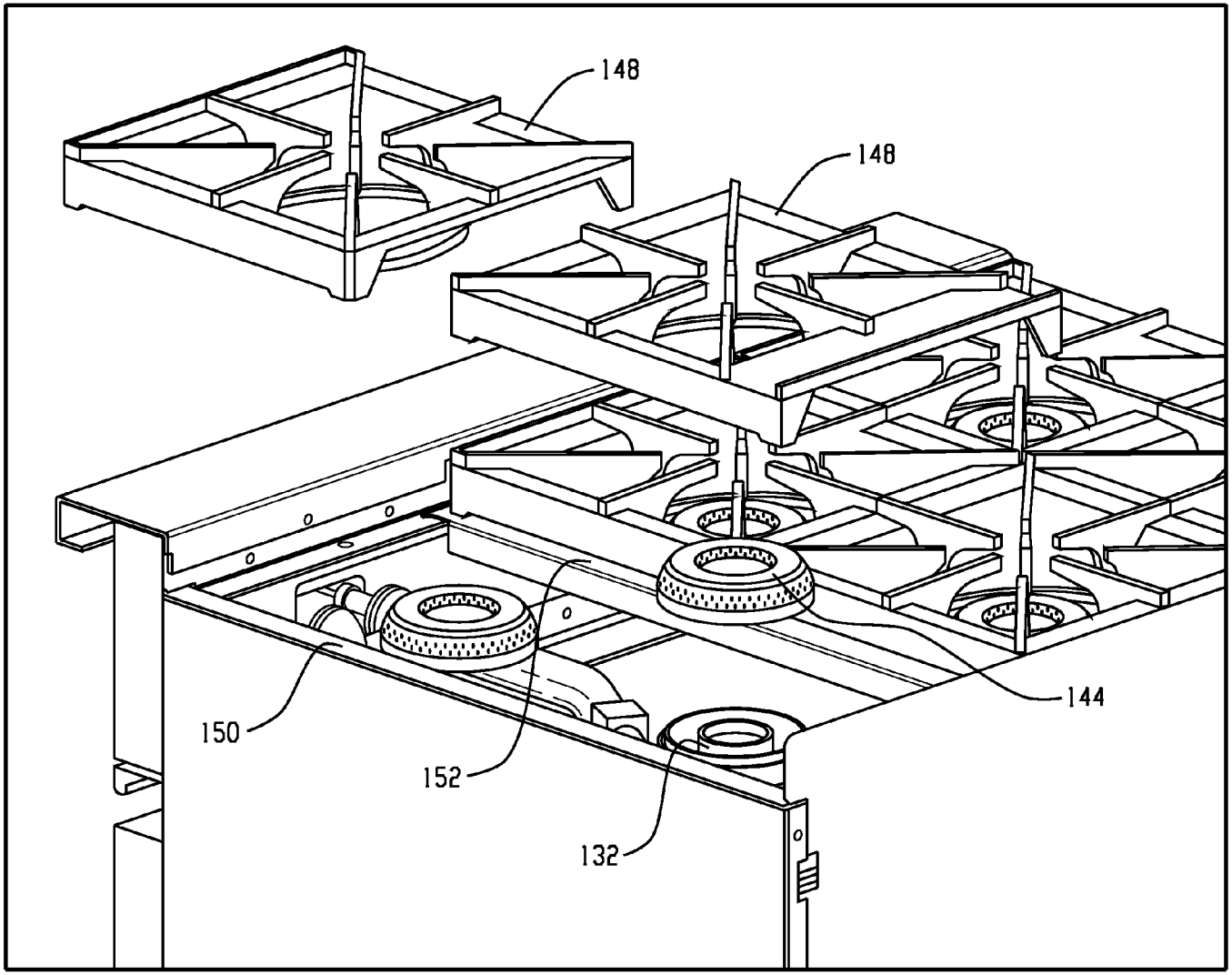
Fig. 3 PRIOR ART
FIG. 3 is an exploded partial view of one embodiment of an open top burner system.

FIG. 3 illustrates an exploded view of cooking locations 104 on cook top 102. Positioned above each burner head assembly 106 is a grate 148 that allows for placement of a cooking apparatus (not shown) above the burner assembly 106. The cooking apparatus may be a pot, pan, rotisserie, or other apparatus useful in the cooking of food products (not shown). Alternatively, food may be positioned directly on or above the grate 148, foregoing the use of cooking apparatus. As further shown in FIG. 3, the grate 148 may be positioned on supports 150, 152 sized to support grate 148 over the burner assembly 106. As shown in FIG. 2, burner head cover 144 is positioned on burner head base 132 to evenly distribute a flame for cooking on grate 148. In order to convert a given open top burner to a radiant burner system, the grate 148 and burner head cover 144 are removed from the applicable cooking location 104.

Figure 4:
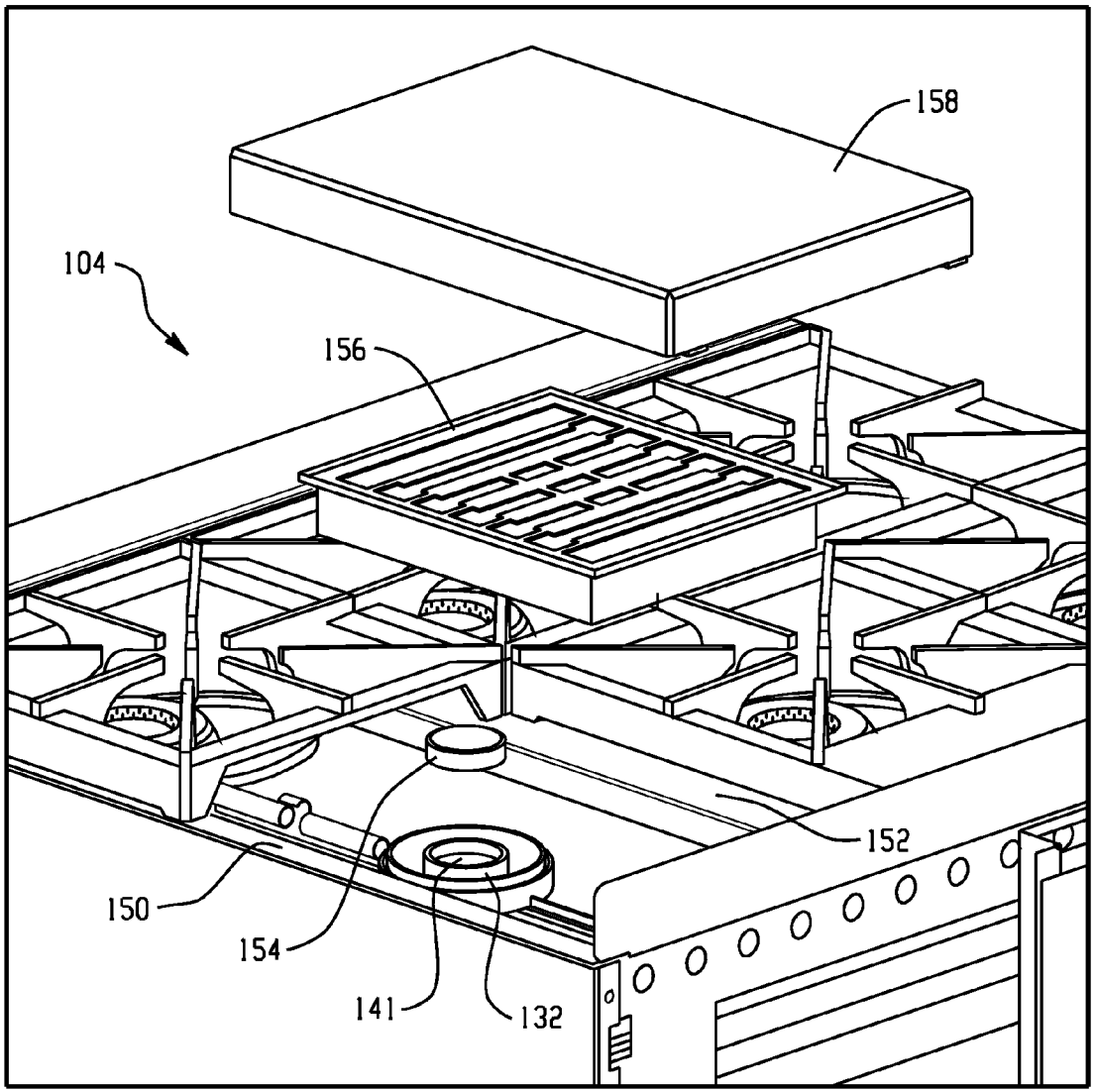
FIG. 4 is an exploded partial view of one embodiment of a radiant burner system.

Conversion of the burner system is further illustrated in FIG. 4. As shown, the grate 148 and burner head cover 144 have been removed. Any regulating restrictor plate over the central opening 141 is also preferably removed, along with any associated igniter that is secured to the restrictor plate. The central opening 141 is plugged with a center hole plug 154 that prevents or severely restricts the ability of secondary air to flow upward through the opening 141. Next, a radiant burner head assembly 156 is positioned on the burner head base 132 so that gas flow is directed upward into and through the radiant burner head assembly 156. Finally, an emitter 158 is positioned on the supports 150, 152, overlapping or covering the radiant burner head assembly 156.

Figure 5:
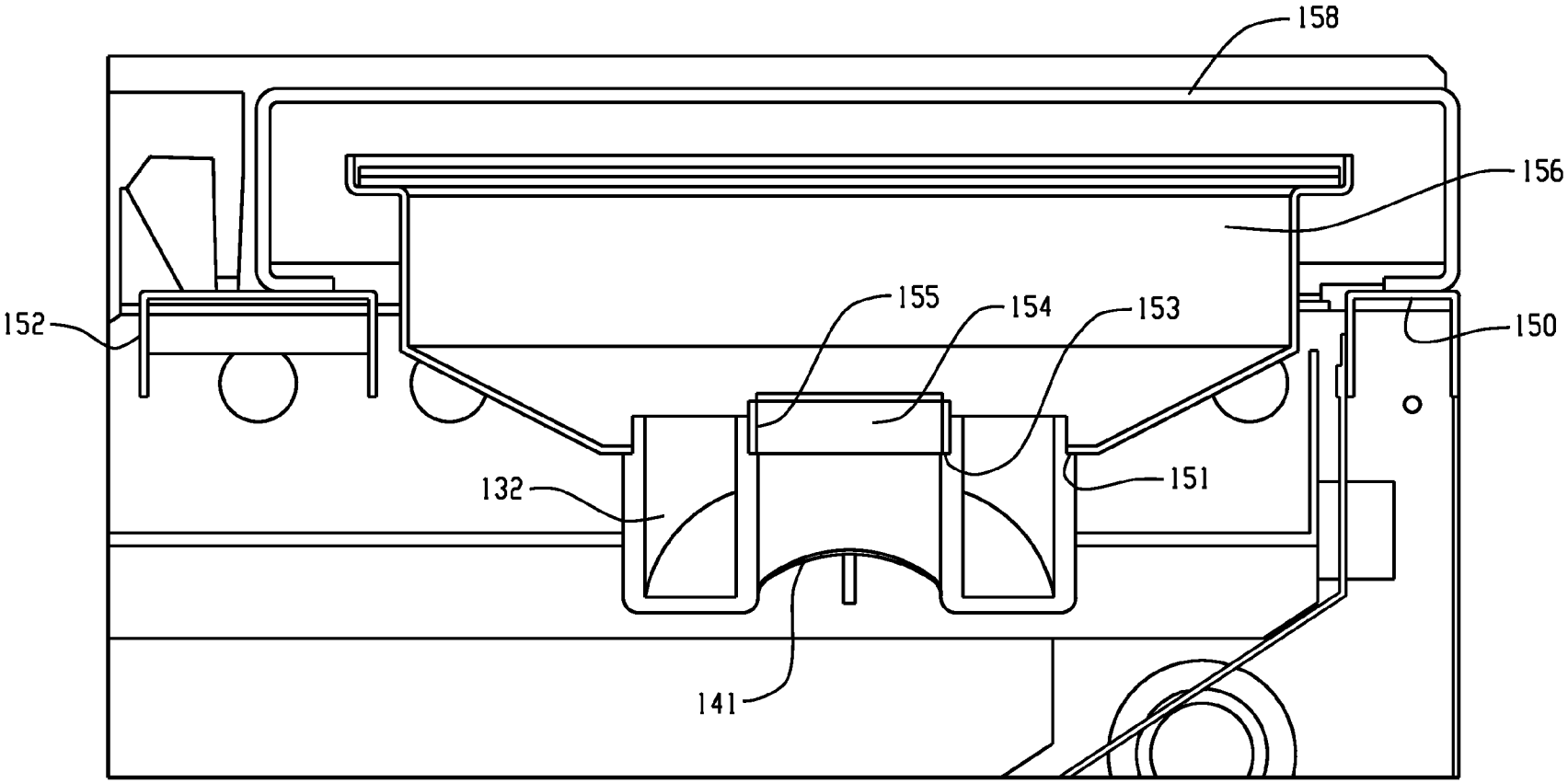
FIG. 5 is a side cutaway or cross-section of one embodiment of the assembled radiant burner system.

FIG. 5 illustrates a side cutaway of the completed radiant burner assembly. As shown in this figure, the center hole plug 154 covers the central opening 141 of the burner head base 132, preventing or limiting airflow therethrough. In the illustrated embodiment, the center hold plug includes a cylindrical wall portion 155 having a bottom edge that rests upon an inner annular supporting ledge 153 of the burner head base, but other configurations are possible. The plug may be sized for a friction tight fit within the central opening 141. The radiant burner head assembly 156 is positioned on the burner head base 132 so that gas flow through the burner head base 132 enters the radiant burner head assembly 156. Finally, the emitter 158 has been positioned on the supports 150, 152 and surrounds the radiant burner head assembly 156 so that heat is transferred directly to the emitter 158.

Figure 6:
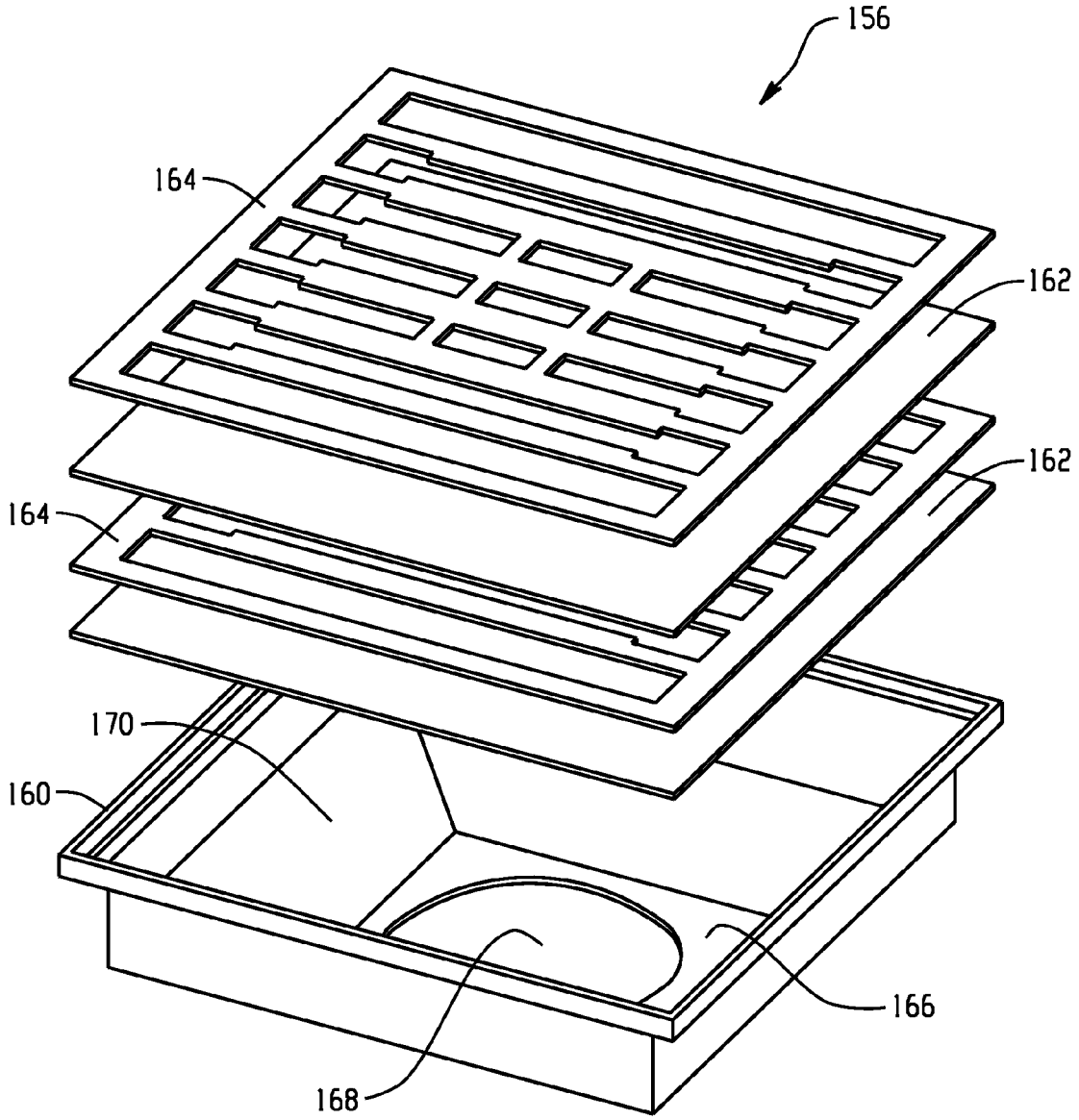
FIG. 6 is an exploded view of one embodiment of the radiant burner head assembly.

FIG. 6 illustrates an exploded view of the radiant burner head assembly 156. The radiant burner head assembly 156 generally includes a plenum housing 160, one or more perforated members 162 and one or more support members 164 (e.g., mounting members). As described in U.S. Pat. No. 7,726,967 to Best, herein incorporated by reference in its entirety, the perforated 162 and support members 164 may be stacked in alternating layers to dissipate heat to the emitter 158 (FIG. 5). In accordance with the exemplary embodiment, each of the perforated members 162 may be fabricated from a nonwoven plate of high temperature metal alloy so that it defines a multiplicity of holes or perforations 56 that extend completely therethrough.

The plenum housing 160 generally consists of a base 166 including a burner opening 168, which in the illustrated embodiment is sized and adapted to fit over and rest upon an outer annular supporting ledge 151 of the burner head base 132 (FIG. 5). However, other configurations for supporting the plenum housing in relation to the burner head base could be used (e.g., feet that extend downward from the housing base and into the annular channel of the burner head base, or supports that extend radially outward from the plenum housing and engage some structure on the range top). In the illustrated embodiment, the plenum housing base 166 is surrounded by upward and outward sloping walls 170 defining a volume of the plenum. As further detailed in the Best '967 patent, combustible gas and air are supplied into the plenum 160 and pass through one or more of the perforated members 162 before being combusted. This combustion serves to heat the emitter 158 (FIG. 5) which in turn is used in cooking food items.

According to one embodiment, the perforated members 162 and support members 164 are connected to the plenum 160 to form a single piece radiant burner assembly 156. This single unit provides a single piece for assembly and makes conversion easier. Alternatively, the perforated members 162 and support members 164 may be secured to one another and constitute a single sheaf that may be easily inserted into the plenum housing 160 during assembly and replaced if necessary during the life of the radiant burner system. It is also contemplated that in another embodiment the plug 154 could be supported within the plenum housing 160 (e.g., via connection to the housing 160) so as to automatically seal the opening 141 when the plenum housing 160 is placed upon the burner head base and/or support the plenum housing in relation the burner head base. In addition, the radiant burner head assembly may, for example, include an associated igniter mounted thereon (e.g., connected to an external surface of the housing 160) with associated wiring to be connected to the existing range wiring, or the radiant burner head assembly may simply include an igniter mount adapted to receive the pre-existing igniter of the open-top burner head assembly to properly position the igniter to ignite gases leaving the top of the radiant burner head assembly.

Figure 7:
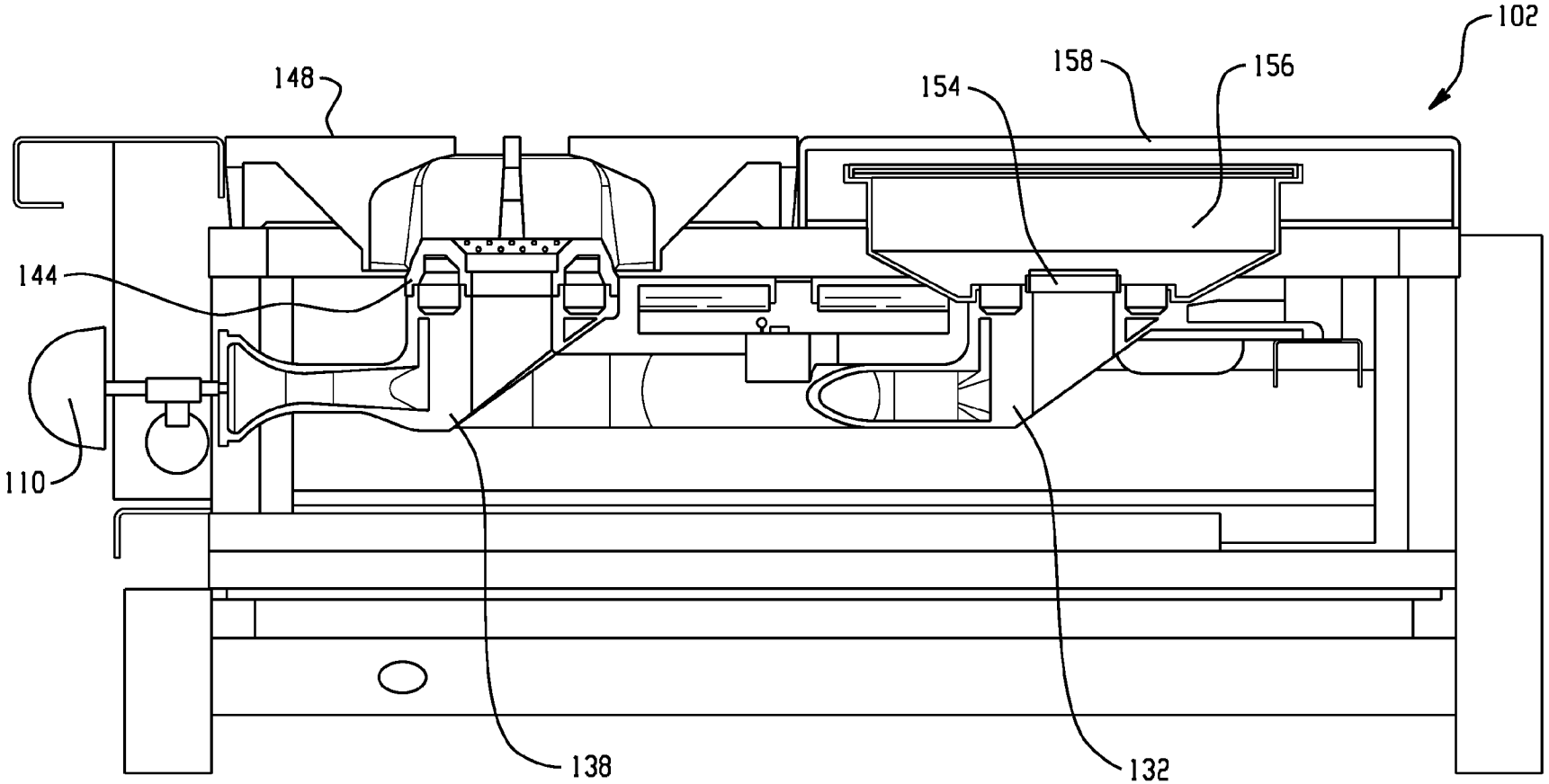
FIG. 7 is a side cutaway or cross-section of one embodiment of the radiant burner head assembly and an open top burner assembly in a dual burner head unit.

FIG. 7 illustrates a side cutaway of a cooktop 102 including a traditional open top burner system and a radiant burner system. As shown in this view, in converting the traditional system to a radiant system the burner head cover 144 and grate 148 have been removed. A center hole plug 154 has been placed in the central opening 141 of the burner head base 132 and a radiant burner head assembly 156 has been positioned over the burner head base 132. Finally, an emitter 158 has replaced the grate 148.

Variations and modifications of the described apparatus will be appreciated by those having skill in the art. For example, the radiant burner head 156 may vary in size or design according to the size, shape, and location of the burner head base 132 in the cooktop 102. The emitter 158 may also vary in size, shape, or design according to the position of supports 150, 152. The emitter 158 is preferably designed to engage the supports 150, 152 in the same manner as the grate 148 of the traditional open top burner system, therefore allowing for easy conversion between a traditional open top burner system and the preferred radiant burner system. Further, as described in Best '967, the materials for the perforated members 162, support members 164, plenum 160, and emitter 158 may vary according to demand.

It is to be clearly understood that the above description is intended by way of illustration and example only, is not intended to be taken by way of limitation, and that other changes and modifications are possible.

What is claimed is:

1. A method of modifying an open-top burner system to a radiant burner system, the open-top burner system including a burner head base with a central opening, and a head cover positioned upon the burner head base, the method comprising:

removing the head cover from the burner head base;

plugging the central opening of the burner head base;

positioning a radiant burner bead assembly over the burner head base; and positioning an emitter over the radiant burner head assembly.

2. The method of claim 1 wherein the radiant burner head assembly comprises a plenum housing and at least one perforated member.

3. The method of claim 2 wherein the radiant burner head assembly further comprises two or more perforated members and a spacer separating the two or more perforated members from one another.

4. The method of claim 2 wherein the plenum housing includes a bottom portion configured to rest upon the burner head base so as to support the radiant burner head assembly in relation to the burner head base.

5. The method of claim 4 wherein the bottom portion rests upon an annular outer ledge of the burner head base.

6. The method of claim 5 wherein a plug member plugs the central opening of the burner head base and includes a bottom edge that rests upon the annular inner ledge of the burner head base.

7. The method of claim 2 wherein the plenum housing includes a bottom opening that is disposed about a top portion of the burner head base, and upwardly sloping sidewall portions extending from the bottom opening.

8. The method of claim 1 wherein said stovetop includes a grate support and said emitter engages said grate support to hold the emitter above the radiant burner head assembly.

9. A method of modifying an open-top burner system to a radiant burner system, the open-top burner system including a burner head base with a secondary airflow opening, and a head cover positioned upon the burner head base, the method comprising:

removing the head cover from the burner head base;

blocking the secondary airflow opening of the burner head base;

positioning a radiant burner head assembly over the burner head base; and positioning an emitter over the radiant burner head assembly.

10. The method of claim 9 wherein the radiant burner head assembly comprises a plenum housing and at least one perforated member.

11. The method of claim 10 wherein the radiant burner head assembly further comprises two or more perforated members and a spacer separating the two or more perforated members from one another.

12. The method of claim 10 wherein the plenum housing includes a bottom portion configured to rest upon the burner head base so as to support the radiant burner head assembly in relation to the burner head base.

13. The method of claim 12 wherein the bottom portion rests upon an annular outer ledge of the burner head base.

* * * * *